US005681101A

United States Patent [19]

Peter

[11] Patent Number: 5,681,101

[45] Date of Patent: Oct. 28, 1997

[54] DRAWER SLIDE AND THE METHOD OF PRODUCING IT

[75] Inventor: Havlat Peter, Hard, Austria

[73] Assignee: Grass AG, Austria

[21] Appl. No.: 720,786

[22] Filed: Oct. 3, 1996

[30] Foreign Application Priority Data

Nov. 9, 1995 [DE] Germany ..... 195 41 767.4

[51] Int. Cl.[6] ..... A47B 88/00

[52] U.S. Cl. ..... 312/330.1; 312/348.1; 312/348.2; 403/283

[58] Field of Search ..... 312/330.1, 348.1, 312/348.2, 257.1; 403/283

[56] References Cited

U.S. PATENT DOCUMENTS

| | | | |
|---|---|---|---|
| 3,067,882 | 12/1962 | Ribbens et al. | 312/330.1 X |
| 4,842,351 | 6/1989 | Rock et al. | 312/330.1 X |
| 4,875,747 | 10/1989 | Hollenstein | 312/330.1 |
| 5,090,786 | 2/1992 | Albiez et al. | 312/330.1 |
| 5,370,454 | 12/1994 | Domenig | 312/348.1 |
| 5,462,349 | 10/1995 | Grabher | 312/330.1 X |
| 5,556,183 | 9/1996 | Brustle et al. | 312/330.1 X |
| 5,601,350 | 2/1997 | Rock et al. | 312/348.1 X |

FOREIGN PATENT DOCUMENTS

| | | | |
|---|---|---|---|
| 387701 | 10/1989 | Austria . | |
| 2202312 | 10/1973 | Germany | 312/330.1 |
| 2702217 | 7/1978 | Germany | 312/348.2 |
| 3445880 | 6/1986 | Germany | 312/330.1 |
| 2140671 | 12/1984 | United Kingdom | 312/330.1 |
| 2196835 | 5/1988 | United Kingdom | 312/330.1 |

*Primary Examiner*—Peter M. Cuomo
*Assistant Examiner*—Hank V. Tran
*Attorney, Agent, or Firm*—Kilpatrick Stockton LLP

[57] ABSTRACT

The present invention is a drawer slide and a process to produce it. The described drawer slide is preferred for the quick assembly drawer on which the drawer slide is to be fastened on a drawer side wall. The drawer slide consists of a somewhat Z-shaped profile, which, in the first step of production forms a first holding device for the drawer side wall from the material of the lower horizontal shank of the drawer slide. At least a second holding device for the drawer side wall is formed from the material of the vertical shank of the drawer slides. The drawer side wall is then placed on the lower horizontal shank of the drawer slide and both holding devices are pressed into the material of the drawer side wall.

12 Claims, 2 Drawing Sheets

DRAWER SLIDE AND THE METHOD OF PRODUCING IT

BACKGROUND AND FIELD OF THE INVENTION

The invention pertains to a drawer slide and a method of producing this drawer slide, which is fastened to the drawer side wall, and consists of a somewhat Z-shaped profile with an upper horizontal shank forming a guide slide, a lower horizontal shank carrying the drawer side wall, and a vertical shank connecting the upper and lower horizontal shanks.

The usual standard drawers made from wood or plastic are preferably equipped with metal drawer slides, which guarantee a stabile, durable, secure and smooth operation of the drawer.

Usually drawer slides are securely screwed on the drawer bottom or drawer side walls; but, especially with the so-called quick assembly drawers, a screw connection between the drawer and drawer slide is not desirable because it is tedious, intricate and time consuming. Furthermore, such a system involves additional costs and expense for the installation and necessary screws.

Quick assembly drawers have enabled drawers to be shipped KD (knock-down), to then be assembled by the consumer himself. The drawer producers endeavor to keep the assembly as simple as possible, and, especially, to make a tool-free and simple mounting of the drawer slides feasible. Still, many drawers have a faulty and deficient holding of the drawer slide to the drawer side wall because the secure screw connection is lacking.

Preferably, the drawer slide has a somewhat Z-shaped profile so that the drawer comes into contact with a shank and is fastened on it by suitable means.

The Z-shaped drawer slides have the disadvantage of using more material compared to the earlier U-shaped slides, but are necessary in order to produce a secure connection between the drawer slide and the drawer.

The task of the present invention is to improve and further develop a guide slide of the previously mentioned type, which can be fastened securely to the drawer and, especially, the drawer side wall, and which still can be produced by using the least amount of material possible.

This task is solved by a new type of production process of the drawer slide.

SUMMARY OF THE INVENTION

A process for producing a drawer slide is recommended; whereby, the drawer slide has a somewhat Z-shaped profile from which two holding devices are formed for the drawer side wall. After placing the side wall on the drawer slide, the holding devices of the guide slide are anchored in the material of the side wall; preferably, by pressing the holding device in the material of the drawer side wall.

The first holding device is thereby formed from the lower horizontal shank of the guide slide, and consists of a somewhat rectangular shaped tab. This tab is bent repeatedly in an applicable manner and has a projection on its free end, which points in the direction of the side wall to be inserted.

In the same way, a somewhat rectangular shaped tab is formed from the vertical shank and bent again in the applicable manner, and has on its free end a projection which points in the direction of the side wall to be inserted.

After the drawer side wall is placed on the lower horizontal shank of the guide slides, the tab on the holding fixture is pressed so that it is forced into the side wall material and is anchored there.

The advantage of producing such a drawer slide is that the holding devices are formed directly out of the drawer slide material, which, from the point of view of production, is achieved simply. Except for the drawer slide profile, no additional material is needed for the production of the holding device for the side wall. Except for cutting the holding tabs free, the production of the drawer slide does not result in unnecessary waste or scraps.

Usually two holding fixtures per side wall are sufficient because the side wall is additionally pressed down on the horizontal shank of the drawer slide by the projections of the holding devices. However, more than two holding devices can be provided, if required.

The invention related objectives of the submitted invention results from not only the matter of the particulars of the protection claims, but also the various combinations of the individual protection claims.

All records, documents and evidence, inclusive of the abstract, open and disclosed statements and declarations and indications and features, especially those represented embodiments in the drawings, will be claimed as fundamental and significant inventions, as far as the claims individually or in combinations are relative to the position that the technology is new.

The invention at hand will be explained more precisely by the various embodiments shown by the representational drawings. Hereby, additional significant features and advantages of the innovation will be concluded from the designs and their descriptions.

DESCRIPTION OF THE PREFERRED EMBODIMENT

Figure 1:
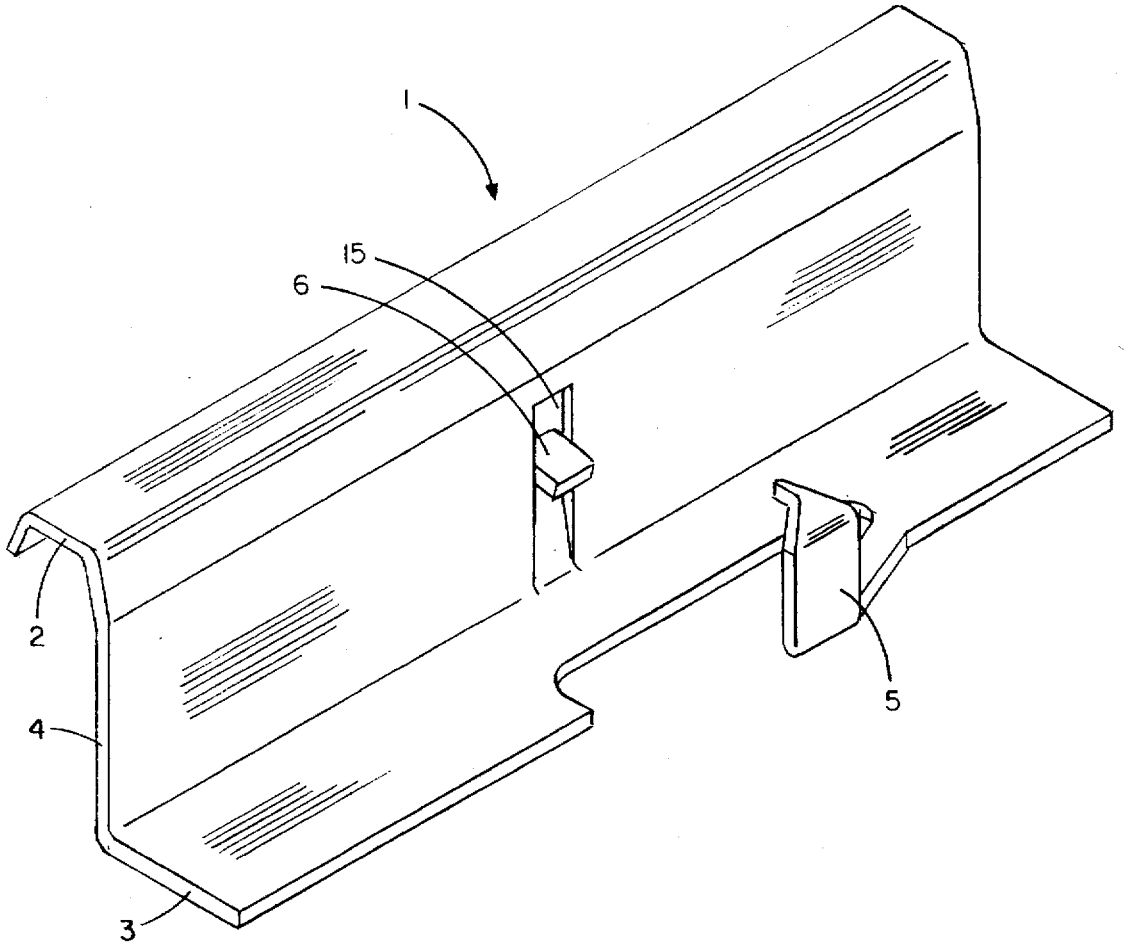
FIG. 1: a perspective view of the completely made drawer slide without the drawer side wall.

FIG. 1 shows the perspective view of the somewhat Z-shaped profile of the drawer slide (1). This has an upper horizontal shank (2), which serves later in the completed stage of the drawer as a guide slide. A vertical shank (4), which verges into a lower horizontal shank (3), is joined with shank (2).

It is noted in the area of the lower horizontal shank that there is a first holding device (5), which is formed from the material of the lower horizontal shank.

Another holding device (6) is formed out of the material of the vertical shank (4), and in the illustrated example, the holding devices (5 and 6) lie somewhat offset to each other. In a later assembly stage, the drawer side wall is placed with its face side on the lower horizontal shank (3) and the drawer slide (1) is anchored by pressing the holding fixtures (5 and 6) in the material of the drawer side wall.

Figure 2:
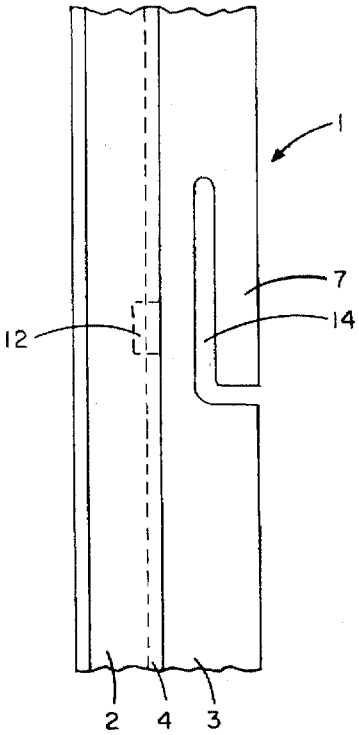
FIG. 2: the drawer slide in the first production stage.

FIG. 2 shows a top view of the drawer slide in the first stage of production, and it is noted, that in the lower horizontal shank (3) a somewhat L-shaped cut (14) is made. With this, a tab (7) is formed which is simply connected on one side with the lower horizontal shank (3).

Figure 3:
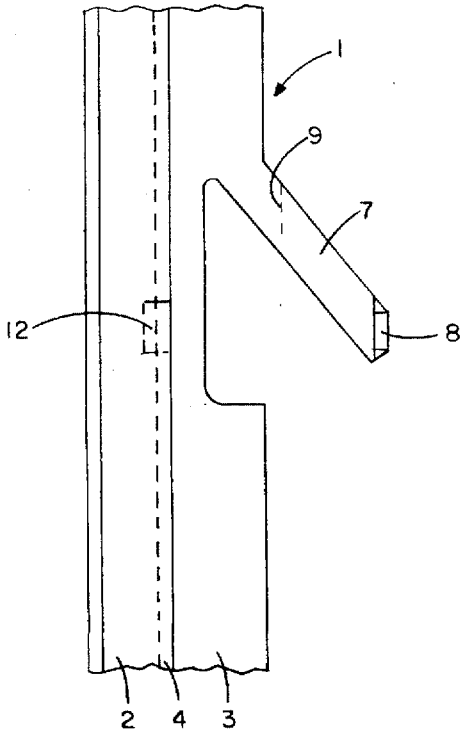
FIG. 3: the drawer slide in the second production stage.

According to FIG. 3, the tab (7) is bent outward about 45 degrees in the area of the connection with the lower horizontal shank (3) inside the surface of the lower horizontal shank. The free end of the tab (7) is simultaneously bent about 90 degrees upward so that a grip-like projection (8) occurs.

Figure 5:
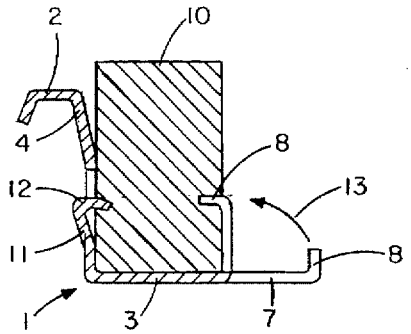
FIG. 5: a section along the line V—V in FIG. 4 with inserted drawer side wall.

The production state shown in FIG. 3 corresponds somewhat to the production state shown in FIG. 5. The lower horizontal shank (3) should be noted again in the sectional embodiment in that the tab (7) extends outward from the same plane, and that it has an upward bending projection (8) on its free end. In the area of the vertical shank (4), there is a somewhat U-shaped cut. (This is best visible in FIG. 1). In reference to FIG. 5, another tab (11) is formed by the cut, which is simply connected by the lower base with the vertical side wall (4). The tab (11) is then bent somewhat (for a maximum of 45 degrees) outwardly in the direction of the upper horizontal shank (2). The tab (11) has on its free end a grip-like projection (12) which is formed by the free end which is bent about 90 degrees in the direction of the side wall (10) to be inserted.

Then the side wall (10) is inserted, and pressure is applied to the tab (11) in the direction of the side wall (10) so that the projection (12) is pressed into the material of the side wall (10) and anchored there. At the same time on the other side of the side wall, the tab (7) is bent in the arrow direction (13) about 90 degrees upward, so that the projection (8) in position (8') is pressed into the material of the side wall (10) and is anchored there. By the advantageous projections (8 and 12) which point slightly down, the side wall (10) undergoes a certain pull in the direction of the lower horizontal shank (3) and is firmly pressed on this. The drawer slide (1) is then firmly connected to the side wall (10).

Figure 4:
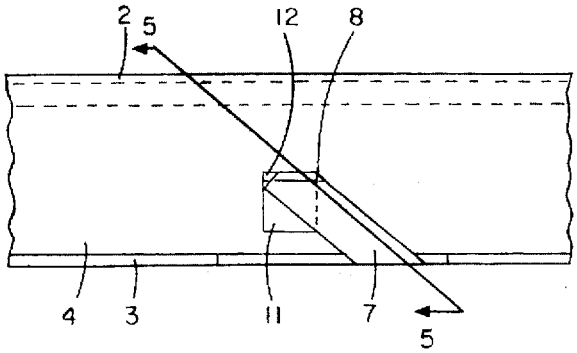
FIG. 4: the completely made drawer slide in the side view without the drawer side wall.

FIG. 4 clarifies again in a lateral view, the end positions of the holding devices (5 and 6) or respectively, the tabs (7 and 11). FIG. 4, however, does not clarify the side wall (10).

It should be noted that the projections (8 and 12) are formed preferably pointed or sharpened in order to guarantee a smooth and easy insertion of the projections into the material of the side wall (10). It is also possible to utilize this holding device of the drawer slide on plastic drawers.

The innovative drawer slide and its production also have more advantages. The drawer slides can be produced cost effectively and material effectively. The drawer slide is especially suited for quick assembly and makes it possible for the customer to assemble it simply without tools.

Drawings Legend

1. Horizontal shank (upper)
2. Horizontal shank (lower)
3. Vertical shank
4. Vertical shank
5. Holding device (first)
6. Holding device (second)
7. Tab
8. Projection 8'
9. Bent line
10. Side wall
11. Tab
12. Projection
13. Arrow direction
14. Cut
15. Cut

What is claimed is:

1. A drawer slide adapted to fasten on a drawer side wall, comprising a somewhat Z-shaped profile with an upper guide slide forming a horizontal shank, a lower horizontal shank with a lateral free edge, and a vertical shank located between the horizontal shanks, wherein at least two holding devices are made from the material of the Z-shaped profile adapted to engage the drawer side wall, a first of the two holding devices being formed as a tab from the lower horizontal shank defined in part by a cut in the lower horizontal shank and in part by a portion of the lateral free edge of the lower horizontal shank, and the tab being bent out away from the vertical shank at an angle relative to the cut in the lower horizontal shank.

2. A drawer slide, according to claim 1, wherein the tab formed from the lower horizontal shank has a free end with a bent projection adapted to be pressed into the material of the drawer side wall.

3. A drawer slide, according to claim 2, wherein a second of the two holding devices is formed as a tab from the vertical shank defined by a cut in the vertical shank, the tab being bent out at an angle relative to the vertical shank.

4. A drawer slide, according to claim 2, wherein the drawer side wall is supported on the lower horizontal shank with the tab formed from the lower horizontal shank bent toward the drawer side wall at an angle of substantially 90 degrees relative to the lower horizontal shank, and adapted to be anchored by the projection of the tab from the lower horizontal shank.

5. A drawer slide, according to claim 3, wherein the tab formed on the vertical shank has a free end with a bent projection adapted to be pressed into the material of the drawer side wall.

6. A drawer slide, according to claim 5, wherein said tab formed on the vertical shank is bent out at an angle up to 45 degrees relative to said vertical shank.

7. A drawer slide, according to claim 5, wherein the drawer side wall is supported on the lower horizontal shank with the tab formed from the lower horizontal shank bent toward the drawer side wall at an angle of substantially 90 degrees relative to the lower horizontal shank, and adapted to be anchored by the projection of the tab from the lower horizontal shank and the projection of the tab formed on the vertical shank.

8. A drawer slide, according to claim 6, wherein said cut in the vertical shank is substantially U-shaped.

9. A drawer slide, according to claim 8, wherein said tab from the lower horizontal shank is bent out at an angle up to 45 degrees relative to said cut in the lower horizontal shank.

10. A drawer slide, according to claim 9, wherein said cut in the lower horizontal shank is substantially L-shaped.

11. A drawer slide, according to claim 1, wherein said tab from the lower horizontal shank is bent out at an angle up to 45 degrees relative to said cut in the lower horizontal shank.

12. A drawer slide, according to claim 11, wherein said cut in the lower horizontal shank is substantially L-shaped.

* * * * *